US006136778A

United States Patent [19]

Kamiya

[11] Patent Number: 6,136,778

[45] Date of Patent: Oct. 24, 2000

[54] ENVIRONMENT SAFEGUARDING AQUEOUS DETERGENT COMPOSITION COMPRISING ESSENTIAL OILS

[76] Inventor: Akira Kamiya, 2-44, Misumi-cho, Chigasaki-shi, Kanagawa-ken, Japan

[21] Appl. No.: 09/357,838

[22] Filed: Jul. 21, 1999

[30] Foreign Application Priority Data

| | | | |
|---|---|---|---|
| Jul. 22, 1998 | [JP] | Japan | 10-222302 |
| Dec. 25, 1998 | [JP] | Japan | 10-376890 |
| Jan. 29, 1999 | [JP] | Japan | 11-021279 |

[51] Int. Cl.[7] ..... C11D 1/10; C11D 3/32; C11D 3/386

[52] U.S. Cl. ..... 510/463; 510/235; 510/238; 510/242; 510/300; 510/365; 510/490; 510/487; 510/501

[58] Field of Search ..... 510/235, 238, 510/242, 300, 365, 463, 490, 487, 501

[56] References Cited

U.S. PATENT DOCUMENTS

| | | | |
|---|---|---|---|
| 5,213,624 | 5/1993 | Williams | 134/40 |
| 5,374,614 | 12/1994 | Behan et al. | 512/3 |
| 5,494,611 | 2/1996 | Howe | 252/548 |
| 5,540,853 | 7/1996 | Trinh et al. | 510/101 |
| 5,585,343 | 12/1996 | McGee et al. | 512/1 |
| 5,661,119 | 8/1997 | Hersh et al. | 510/139 |
| 5,985,819 | 11/1999 | Lu et al. | 510/463 |
| 6,037,319 | 3/2000 | Dickler et al. | 510/439 |

FOREIGN PATENT DOCUMENTS

| | | |
|---|---|---|
| 1221498 | 9/1989 | Japan . |
| 376797 | 4/1991 | Japan . |

*Primary Examiner*—Yogendra Gupta
*Assistant Examiner*—Charles Boyer
*Attorney, Agent, or Firm*—Roylance, Abrams, Berdo & Goodman, L.L.P.

[57] ABSTRACT

The present invention provides an environment safeguarding aqueous detergent composition which maximizes the decomposing action of an enzyme, and minimizes the use of a surface active agent. These compositions are an environment safeguarding aqueous detergent composition containing (a) 0.1 to 20% by weight of one or more chief ingredients selected from the group consisting of essential oils and essential oil components which have been isolated from the essential oils or synthesized, (b) 0.25 to 20% by weight of a surface active agent for solubilizing the chief ingredients, and (c) an enzyme, the weight ratio of the (a) to the (b) being in the range of 1:0.5 to 1:15, and an environment safeguarding, dishwashing detergent composition containing (a) 0.1 to 5.0% by weight of an essential oil component selected from the group consisting of a terpene alcohol, limonene, pinene, linalyl acetate, and bornyl acetate, and (b) 3.0 to 20.0% by weight of an N-acylamino acid salt for solubilizing the above chief ingredient, the composition having pH in the range of 8.0 to 4.0, or a home care products washing detergent composition prepared by diluting the environment safeguarding, dishwashing detergent composition.

7 Claims, 3 Drawing Sheets

LINALOOL, N-ACYLAMINO ACID AND PANCREATIN

LINALOOL, COCONUT FATTY ACID DIETHANOLAMIDE AND PANCREATIN

ENZYME (STORED IN A REFRIGERATOR)

PRIOR ART DETERGENT

ENZYME AND WATER

ENVIRONMENT SAFEGUARDING AQUEOUS DETERGENT COMPOSITION COMPRISING ESSENTIAL OILS

BACKGROUND OF THE INVENTION

The present invention claims the priority of Japanese Patent Application Nos. 10-222302 filed Jul. 22, 1998, 10-376890 filed Dec. 25, 1998 and 11-21279 filed Jan. 29, 1999 which are incorporated herein by reference.

A first aspect of the present invention relates to an environment safeguarding aqueous detergent composition containing one or more chief ingredients, a surface active agent, and an enzyme, the chief ingredients being selected from the group consisting of essential oils and essential oil components which have been isolated from the essential oils or synthesized. This detergent composition finds use, domestically, in laundry detergents for clothes; dishwashing detergents; bath detergents, especially, for physically handicapped persons or elderly persons, or for whole-body beauty treatment of women intended even for removing dirt of pores of the skin; detergents for partial dermal treatment of the foot or the like; bathtub scale detergents which remove scale on a bathtub regardless of the material making up the bathtub; detergents for the inside of a bath furnace; detergents for fungal degradation; detergents for sanitary ware, such as a toilet bowl or urinal; and cleaning agents for drain pipes. The detergent composition is also used for exterior detergents for vehicles such as automobiles or electric railcars, or transportation devices such as airplanes; detergents for washing the exterior, floor, tile, glass, etc. of a building with water; detergents for dishwashers at restaurants, etc.; detergents for washing kitchen instruments, utensils, floor, gutter, etc. with water; and detergents for removing agricultural chemicals adhering to farm produce. For industrial applications, the detergent composition is used for refining of vegetable fibers, refining of wool or silk, refining of raw hide, or as a deinking agent for paper pulp. The detergent composition also functions as a detergent capable of preventing clogging of a drain pipe when its waste liquor is discharged after treatment with the detergent.

A second aspect and a third aspect of the present invention relate to a dishwashing detergent composition containing an essential oil component selected from the group consisting of terpene alcohol, limonene, pinene, linalyl acetate, and bornyl acetate, and an N-acylamino acid salt, and an environment safeguarding, aqueous detergent composition for home care products which has been produced by diluting the dishwashing detergent composition at a dilution ratio of about 2 to 10. Uses of these detergent compositions include manual washing of tableware; washing of oil in heating instruments, such as electric oven, fryer, oven, cooker, and griddle; washing of oil in drainage and exhaust equipment, such as air fan, duct, filter and drainage port; microbial elimination and cleaning of kitchen utensils, such as chopping board, rice washer, vegetable slicer, and sink; interior cleaning of storage devices, such as refrigerator, freezer, and cold table; exterior washing of stainless steel implements, washing of tile in floor and wall; cleaning of rigid-surface articles, such as counter, table and chair; cleaning of glass or the like; cleaning of sanitary ware, such as wash basin and toilet bowl or urinal; cleaning of steel furniture, such as office supplies; cleaning of instruments incorporating electric appliances, such as OA devices and television set; cleaning of leather goods, such as sofa; cleaning of boarding and cloth-hanged wall; cleaning of bathtub, wall or floor made of plastics or porcelain enamel; cleaning of interior fixtures in automobiles; washing of metallic or chemical conversion tools; and washing of automatic dishwashers. These detergent compositions also function as detergents which can prevent clogging of a drain pipe when their waste liquors are discharged after treatment with the detergents.

Detergents, which have been used so far, mainly consist of surface active agents. The detergents perform washing by emulsifying or dispersing polymers and fats adhering as dirt under the action of the surface active agent, and separating the emulsified or dispersed polymers and fats from an article to be washed. Among such detergents of the surfactant type, enzyme-containing products are also produced and sold. However, these products have posed heavy problems. That is, the surface active agent contained therein surrounds the fats, etc. Thus, the enzyme is kept from contacting the fats, etc., and its function of acting on the fats, etc. to decompose them is greatly restricted, or its enzymatic capability is lost under a protein denaturing action. In recent years, light has been cast intensively on the theme of environment safeguarding. From this point of view, the use of a detergent containing a large amount of a surface active agent has resulted in its release as household drain into rivers. This has led to deterioration of the environment including rivers, and as a consequence, at water treatment plants, the burden of water treatment has been markedly increased.

No detergent has had excellent detergency for all objects to be washed, and has been safe for both of humans and the environment. The detergents in use have been classified by dirt as types for vegetables, tableware, oils adhering to electric ovens, etc., bath scale, household use on nicotine of tobacco, and so on. The detergents are also classified by use into various types, such as those for cleaning a rigid surface of glass or a stone material, e.g., earthenware, for the rigid surface of OA devices made of chemical products, for tatami or carpets, and for earthenware in a toilet. These classifications are uneconomical for consumers, and it is impossible to centrally grasp the safety and influence on the environment of their liquids or scattered spray settling on the skin or mucosa. Thus, their detergency, their safety with respect to humans, and the environmental safety of their waste liquors have not been compatible. Detergents, which are used while being scattered in the air, contaminate the air, or may cause allergic reactions to chemical products. Detergents having various compositions turn into waste liquors, which are discharged into rivers through household drains. These wastes impair the cleaning ability of aerobic microorganisms in the rivers, thereby deteriorating the environment. At water treatment plants, they also markedly increase the burden of water treatment. In recent years, during the process of purification of detergents that is performed in sewers, rivers and seas, detergent compositions have been regarded as arousing chemical reactions to create endocrine disrupting chemicals. This has posed new problems.

Detergents for degreasing home care products have contained petroleum derived surface active agents, organic solvents, etc. Their solutions are alkalis with pH of 8 or higher, and have dissolved oils and fats by means of the alkalis. A soap such as a fatty acid sodium salt or a fatty acid potassium salt, which is used in a dishwashing detergent, is highly biodegradable, and is favorable to the environment, but it is alkaline, and therefore damages the skin. A detergent containing a petroleum derived surface active agent or an organic solvent has necessitated the wearing of rubber gloves or the like. A detergent from petroleum, typified by a straight chain alkylbenzene-sulfonate is neutral at pH 6.0 to 8.0, but causes protein denaturation, chapping the skin. Washing of tableware is a task which must be done every day, thus posing a serious problem to health. Particularly when a dishwasher is used, the detergent for it contains sodium hydroxide as a detergent component, which is highly alkaline and dangerous. The use of a nonionic surface active agent with low alkalinity and causing little foam results in low detergency. The remaining dirt leads to troubles due to bacterial growth.

Recently, the use of surface active agents of natural origin has increased in view of adverse influence on the environment. However, their surface activity is too weak to wrap up the removed fats and oils during transportation to the main sewerage. Thus, the removed fats and oils deposit on the drainage piping ranging from the house to the road, causing frequent troubles due to clogging. Particularly in a housing complex, a single drainage pipe is shared among many houses, so that the increase in clogging-associated troubles has become a serious problem in the community.

Proposals have been made for a household detergent for a rigid surface, or a glass detergent containing citrus essential oils or terpene hydrocarbons (Japanese Unexamined Patent Publication No. 3-76797), and a bathroom scale detergent containing hydrocarbons, alcohol components, and esters (Japanese Unexamined Patent Publication No. 1-221498). Since these detergents contain organic solvents as principal components, their use as sprays irritates the eye and mucosa upon scattering. As a result, they may cause dermal allergy, adversely affecting health.

SUMMARY OF THE INVENTION

The first aspect of the present invention has been accomplished to solve the foregoing problems. It maximizes the decomposing action of an enzyme, and minimizes the discharge of a surface active agent. Essential oils have been known as perfumes, and have been found to rapidly dissolve liquid or solid polymers or fats and oils, or rapidly finely divide them to convert them into emulsions, gels or creams, i.e., to emulsify, disperse, gel, solate, cream, or solidify them. If an enzyme is coexistent, the contact of the enzyme with the fats and oils, etc., which have been liquefied, and proteins and starches becomes easy. This makes the area of action of the enzyme very large, thus making it possible to decompose the fats and oils, etc. in a short time. Essential oils and essential oil components, which have been isolated from the essential oils or which have been synthesized, penetrate fats and oils to dissolve them, thus increasing the area of action of the fat and oil decomposing enzyme. The essential oils and essential oil components also disperse proteins and starches in addition to the fats and oils. The opportunity for the action of the decomposing enzyme on them is thus expanded, whereby the ability of the enzyme can be exhibited 100%.

The second and third aspects of the present invention provide a weakly acidic, versatile detergent for home care products, which, even when adhering to the skin, does not chap it, which does not irritate the eye or mucosa by a scattered liquid, which is safe and harmless, which has disinfectant, bacteriostatic ability, which has a rust preventive effect, which has such excellent detergency as to be used without limitation, which is free from organic solvents, and which requires a reduced amount of a surfactant. As a manual dishwashing detergent, there is provided a multipurpose detergent which does not roughen the hand, which is weakly acidic, which has excellent detergency with a decreased amount of a surface active agent, whose waste liquor after washing dissolves oils and fats depositing on a drainage pipe to prevent its clogging, and whose components are environmentally safe. To serve as an automatic dishwasher detergent, there is provided an antibacterial, neutral detergent having excellent detergency. Their detergency dissolves fats and oils, and prevents the fats and oils in waste liquor from depositing on a drainage piping and clogging it.

The inventor of the present invention conducted extensive studies, and sorted out essential oil components having fat and oil solvency from essential oil components which are free from skin irritating properties or sensitizing properties, which have no oral or percutaneous toxicity, which cause no influence or discomfort to the body because of smell, and whose in vivo metabolism has been elucidated. The following components have been found to have excellent solvency for fats and oils: Linalool, terpineol, terpineol-4, and geraniol among monoterpene alcohols; limonene, and pinene among monoterpene hydrocarbons; and acetic acid esters, such as bornyl acetate, and linalyl acetate, among esters. Phenols, oxides, and ethers are toxic, and their use in the present invention is not preferred. In addition, essential oils themselves differ in components according to the place of origin, or according to the year of harvest even when the place of origin is the same. Thus, they may contain components having toxicity, and so have been excluded from the embodiments of the present invention.

Essential oil components have hitherto been solubilized with the use of organic solvents. However, organic solvents are carcinogenic when adhering to the skin. Besides, they are largely chemically stable compounds, and are slowly biodegradable. Furthermore, they do not exist in the natural world. Thus, their use is not preferred.

As a result of extensive research, the inventor has found that some essential oil components, which have oil and fat solvency and are safe, dissolve in N-acylamino acid salts to form aqueous liquids. The inventor has also found that other essential oil components make highly stable solutions when sucrose fatty acid esters or fatty acid alkylolamides are added together with N-acylamino acid salts. For example, linalool or terpineol fully dissolves merely with an N-acylamino acid salt such as N-acylalanine salt or N-acylglutamate. Limonene or pinene fully dissolves upon addition of a fatty acid alkylolamide or a sucrose fatty acid ester besides the above-mentioned N-acylamino acid salt. For linalyl acetate or bornyl acetate, a fatty acid alkylolamide is added besides the above-mentioned N-acylamino acid salt.

A dishwashing detergent composition or an aqueous composition for washing home care products, as the second or third aspect of the present invention, is a versatile detergent safe for both of humans and the environment, because it does not chap the skin; it has detergency equal to or better than that of conventional detergents even though the content of a surface active agent is lower; and it has the effect of preventing clogging of drainage piping owing to the fat and oil solvency of essential oil components in its waste liquor.

According to the second and third aspects of the present invention, as described above, the essential oil component is solubilized with a specific surface active agent. The essential oil component that has formed an aqueous liquid directly acts on an object to be washed, without having its action impaired by a solvent or the like. Thus, the amount of the surface active agent may be very small, and yet the present invention has excellent detergency. Furthermore, the essential oil component has pharmacological action, and the N-acylamino acid salt has a skin chap preventing action. Thus, the detergent is easy on the skin, and free from irritation to the eye or mucosa due to a scattered liquid.

In the present invention, the detergent is defined as "environment safeguarding" for the following reasons: As stated above, a surface active agent with marked adverse influence on the environment is not used, but a relatively environment-friendly surface active agent is used, with its discharge being minimized. The essential oils, and the essential oil component isolated therefrom or synthesized, volatilize after use, and do not adversely affect rivers. Even after discharge as drain, their active ingredient can wash the drainage pipe. In addition, the detergent composition of the present invention uses naturally occurring substances, so that it is harmless to living creatures, and friendly to the environment. As seen from these facts, the detergent of the present invention is a product worth the name of an environment purifying agent. The essential oil component selected from the group consisting of terpene alcohol, limonene, pinene, linalyl acetate, and bornyl acetate (hereinafter referred to as terpene alcohol, etc.) does not use an organic solvent for its solubilization, and does not disrupt balance in the natural world. Nor do the terpene alcohol, etc. adversely affect rivers, since they volatilize after being used.

The aqueous detergent composition of the first aspect of the present invention does not use a surface active agent as a main component, namely, as a washing component. That is, the surface active agent is used in such an amount as to dissolve in water one or more chief ingredients selected from the group consisting of essential oils and essential oil components which have been isolated from the essential oils or synthesized, and is not used to emulsify polymers or fats. Hence, the amount of the surface active agent used may be very small. The surface active agent used in the present invention, if it is of a particular type, has been found to be effective in dissolving, gelling, solating or creaming essential oils, etc.

The first aspect of the present invention provides an environment safeguarding aqueous detergent composition containing (a) 0.1 to 20% by weight of one or more chief ingredients selected from the group consisting of essential oils and essential oil components which have been isolated from the essential oils or synthesized, (b) 0.25 to 20% by weight of a surface active agent for solubilizing the chief ingredients, and (c) an enzyme, the weight ratio of the (a) to the (b) being in the range of 1:0.5 to 1:15.

According to the dishwashing detergent composition or the aqueous home care products washing detergent composition as the second or third aspect of the present invention, a terpene alcohol or the like is solubilized only with an N-acylamino acid salt which is a surface active agent. The solubilized terpene alcohol is not inhibited by a solvent or the like, but directly acts on an object to be washed. If desired, a sucrose fatty acid ester or a fatty acid alkylolamide is added. Thus, the amount of the surface active agent may be enough to solubilize the terpene alcohol or the like, and although its amount is very small, excellent detergency is afforded. At the same time, the skin protecting effect of the terpene alcohol and the skin chap preventing effect of the N-acylamino acid salt are not inhibited by other solubilizing substances or materials incorporated. Thus, a detergent very easy on the skin and free from irritation to the eye or mucosa due to a scattered liquid was obtained.

The second aspect of the present invention provides an environment safeguarding, dishwashing detergent composition containing (a) 0.1 to 5.0% by weight of an essential oil component selected from the group consisting of a terpene alcohol, limonene, pinene, linalyl acetate, and bornyl acetate, and (b) 3.0 to 20.0% by weight of an N-acylamino acid salt for solubilizing the above chief ingredient, the composition having pH in the range of 8.0 to 4.0.

The third aspect of the present invention provides an environment safeguarding, aqueous, home care products washing detergent composition containing the components (a) and (b) diluted with water at a dilution ratio of 2 or more.

A detailed description of these compositions will follow.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
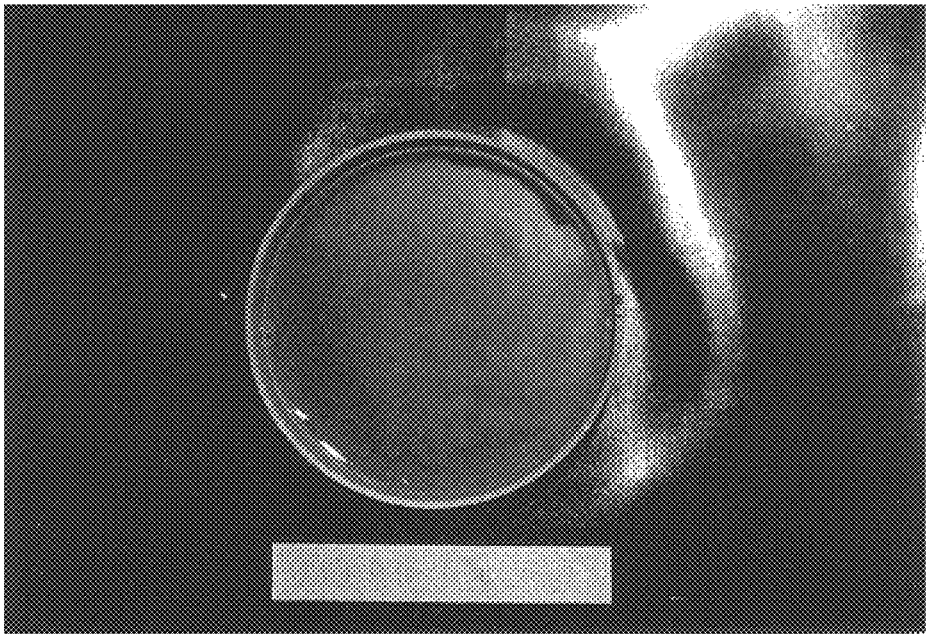
FIG. 1 is a photograph of lard treated in accordance with Example 1, in which a clear aqueous detergent was added to the lard, and the mixture was allowed to stand for 30 minutes, and then stored in a refrigerator for 60 minutes until the liquid temperature became 10° C. or lower.
Figure 2:
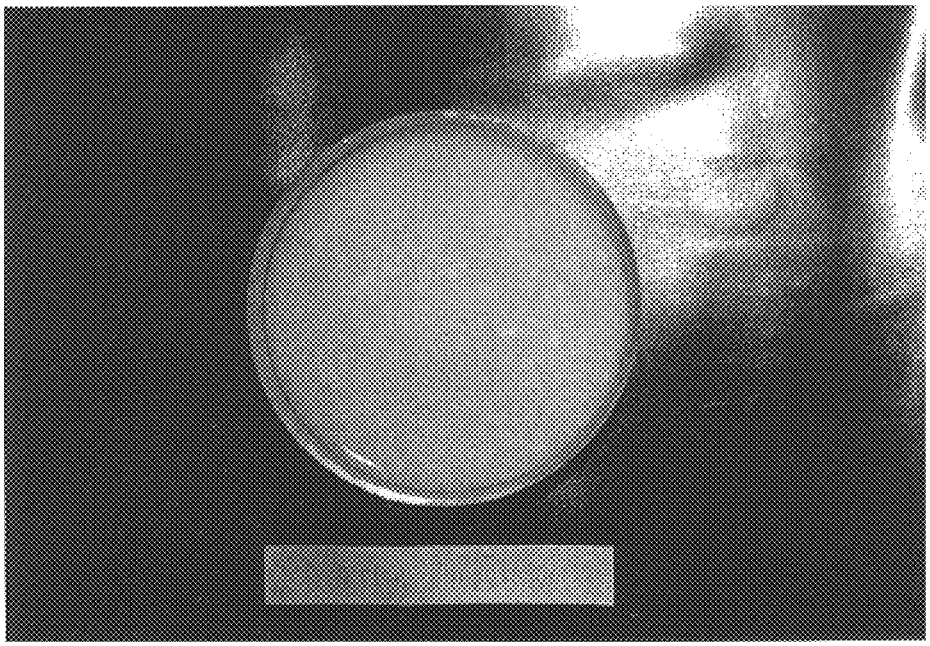
FIG. 2 is a photograph of lard treated in accordance with Example 71, in which a sol-form aqueous detergent was added to the lard, and the mixture was allowed to stand for 30 minutes, and then stored in a refrigerator for 60 minutes until the liquid temperature became 10° C. or lower.
Figure 3:
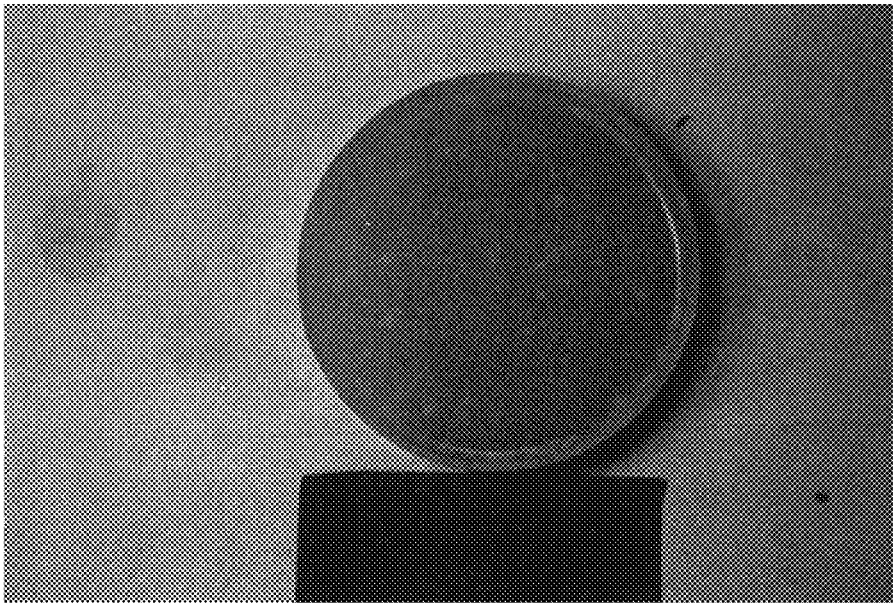
FIG. 3 is a photograph of lard treated in accordance with Example 68, in which a sol-form aqueous detergent was added to the lard, and the mixture was allowed to stand for 30 minutes, and then stored in a refrigerator for 60 minutes until the liquid temperature became 10° C. or lower.
Figure 4:
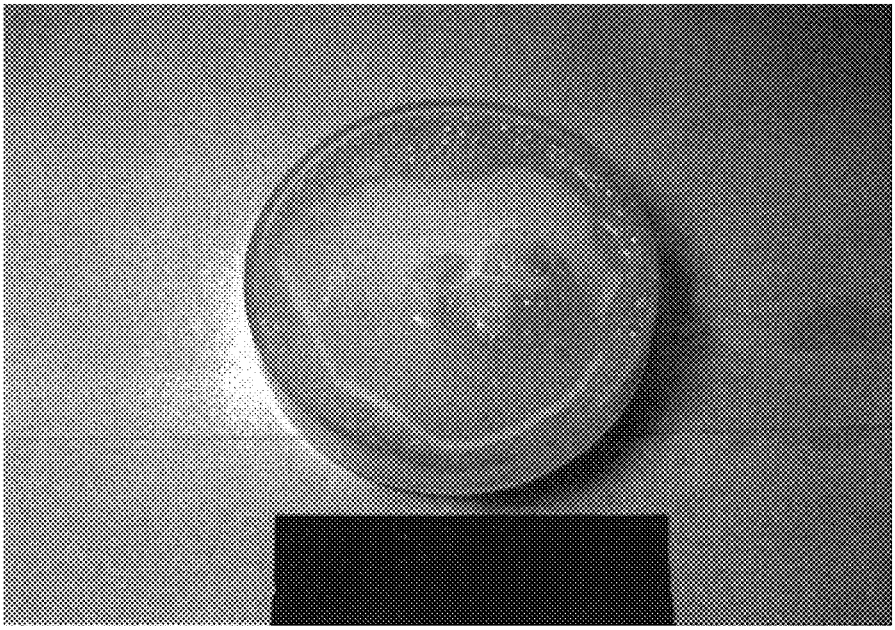
FIG. 4 is a photograph of lard treated in accordance with the method of Comparative Example 1, in which a commercially available kitchen detergent was added to the lard, and the mixture was allowed to stand for 30 minutes, and then stored in a refrigerator for 60 minutes until the liquid temperature became 10° C. or lower.
Figure 5:
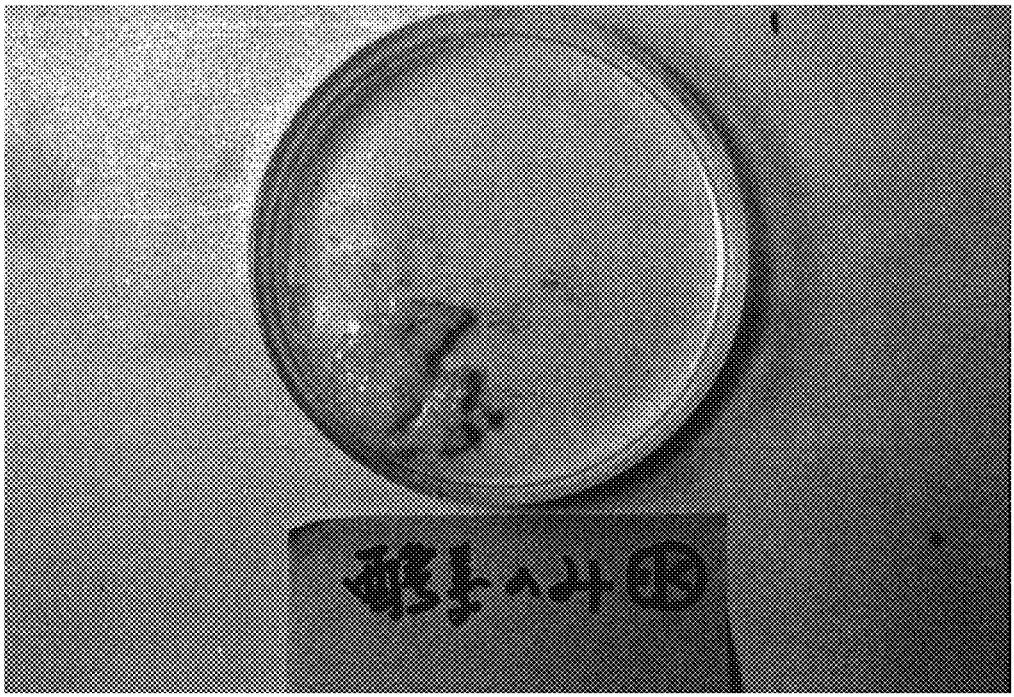
FIG. 5 is a photograph of lard treated in accordance with the method of Comparative Example 2, in which an enzyme and water were added to the lard, and the mixture was allowed to stand for 30 minutes, and then stored in a refrigerator for 60 minutes until the liquid temperature became 10° C. or lower.

The essential oils used in the present invention are abies, bitter, seed, angelica, anise, balsam, basil, bay, benzoin, bergamot, birch, rose, cajuput, calamus, cananga, capsicum, caraway, cardamon, cassia, Japanese cinnamon, acacia, cedarwood, celery, camomile, hay podge, cinnamon, citronella, clove, coriander, costus, cumin, dill, elemi, estragon, eucalyptus, fennel, galbanum, garlic, geranium, ginger, ginger grass, grapefruit, guaiac wood, white cedar, hinoki, hop, hyacinth, Jasmine, jonquil, juniper berry, laurel, lavandin, lavender, lemon, lemongrass, lime, linaloe, richea cubeb, lovage, mandarin, mint, minosa, mustard, myrrh, myrtle, narcissus, neroli, nutmeg, oak moss, ocotea, olibanum, onion, opopanax, orange, oris, parsley, patchouli, palmarosa, pennyroyal, pepper, perilla, petitgrain, pimento, pine, rose, rosemary, camphor, clary sage, sage, sandalwood, spearmint, spike, star anise, styrax, thyme, tonka, tuberose, terpin, vanilla, vetiver, violet, wintergreen, worm wood, and ylang ylang. These essential oils may be used alone or in combination. Of these essential oils, terpin, pine, orange, ocotea, lemon, lemongrass, lavender, citronella, cedarwood, and hinokiol, which can be obtained in large amounts, are used economically and efficiently.

Among the components that have been isolated from these essential oils, or that have been synthesized, there are alcohols, such as citronellol, geraniol, nerol, linalool, menthol, α-, β- or γ-terpineol, borneol, and β-caryophyllene. The alcohols do not deteriorate chemical products, and thus are suitable for all types of washing, such as washing of clothing and tableware. Among them are also included hydrocarbons, such as β-myrcene, α- and β-pinene, limonene, α- and γ-terpinene, and terpinolene. Also included are esters, such as geranyl acetate, linalyl acetate, bornyl acetate, benzyl acetate, and methyl benzoate. Other examples included are ethers, aldehydes, ketones and phenols. These isolated or synthesized components may be used alone or in combination. According to the present invention, it is preferred to select the terpene alcohols, terpene hydrocarbons, and essential oil esters, in consideration of safety based on the pharmacological aspects of essential oil components.

The terpene alcohols used in the second and third aspects of the present invention are in acidic ranges like the pH of the human skin, and have been experimentally confirmed to cause no damage to the skin. Medically, they have been ascertained to have none of oral toxicity, dermal irritancy, sensitizing properties, phototoxicity, and neurotoxicity, and to be safe in children to elderly people and debilitated persons.

The terpene alcohols used in the second and third aspects of the present invention are citronellol, geraniol, nerol, linalool, menthol, α-, β- or γ-terpineol, terpinenol-4, borneol, and β-caryophyllene. The essential oil components used in this invention, except the terpene alcohols, are limonene, pinene, and linalyl acetate or bornyl acetate.

The one or more chief ingredients (a) selected from the group consisting of essential oils and essential oil components isolated from the essential oils or synthesized, which are used in the aqueous detergent composition of the present invention, are used in an amount of 0.1 to 20% by weight, preferably 0.25 to 5% by weight, based on the weight of the aqueous detergent composition. In this case, the surface active agent (b) is used in an amount of 0.25 to 20% by weight, preferably 2 to 15% by weight. However, the weight ratio of the (a) to the (b) is in the range of 1:0.5 to 1:15. The preferred range is 1:1 to 1:6 for washing of clothing, 1:5 to 1:9 for dishwashing, and 1:3 to 1:6 for whole-body bathing. These weight ratios indicate that the amount of the surface active agent used may be very small compared with conventional products.

In the dishwashing detergent composition, the terpene alcohols (a) are used in an amount of 0.1 to 5.0% by weight, preferably 0.25 to 3.0% by weight, based on the weight of the aqueous detergent composition. In this case, the N-acylamino acid salt (b) is used in an amount of 3.0 to 20.0% by weight, preferably 4.5 to 15.0% by weight. However, the weight ratio of the (a) to the (b) is in the range of 1:0.5 to 1:15. The preferred range is 1:2 to 1:12. These weight ratios indicate that the amount of the surface active agent used may be very small compared with conventional products.

For the aqueous, home care products washing detergent composition, the dishwashing detergent composition is used after dilution with water at a dilution ratio of about 2 to 15. For severely oil-stained objects, such as a microwave oven or a cooking stove, the dishwashing detergent composition is diluted from 1:2 to 1:5. For relatively little-stained objects, such as glass, the dishwashing detergent composition is diluted from 1:2 to 1:15.

The most preferable surface active agent used in the present invention, which emulsifies, creams, solubilizes, gels, or disperses the one or more chief ingredients selected from the group consisting of essential oils and essential oil components (including terpene alcohols) isolated from the essential oils or synthesized, is an N-acyamino acid salt, particularly because it does not inhibit the activity of an enzyme. The amino acid in the N-acylamino acid salt may be any one as long as it is an L-amino acid constituting protein, or a fatty amino acid. The preferred amino acids are L-glutamic acid and L-aspartic acid as hydrophilic acidic acids, and L-arginine and L-lysine as basic acids. The most preferred amino acids are DL-alanine and DL-glycine which are fatty acids. Examples of the fatty acids constituting the N-acylamino acid salts are coconut fatty acids, stearic acid, myristic acid, palmitic acid, oleic acid, linoleic acid, linolenic acid, lauric acid, tridecylic acid, pentadecylic acid, heptadecylic acid, nonadecanoic acid, arachic acid, and behenic acid. Particularly preferred are fatty acids having 6 to 18 carbon atoms. Of them, the coconut fatty acids are particularly preferred. As their salts, sodium salt, potassium salt, and triethanolamine salt are named. Examples of the N-acylamino acid salts are triethanolamine N-cocoyl-DL-alanine, N-cocoyl-L-glutamates (sodium salt, disodium salt, potassium salt, dipotassium salt, and triethanolamine salt; of them, the dipotassium salt and the triethanolamine salt are stable; when mixed with terpene alcohols, they form solutions), triethanolamine L-lauroyl-L-glutamate, sodium L-lauroyl-L-glutamate, potassium L-lauroyl-L-glutamate, sodium N-myristoyl glutamate, potassium N-myristoyl glutamate, disodium N-stearoyl glutamate, sodium N-stearoyl-L-glutamate (creamy when mixed with terpene alcohol), sodium N-cocoyl sarcosinate, triethanolamine N-lauroyl sarcosinate, sodium N-cocoyl-DL-alanine, sodium N-cocoyl glycinate, sodium N-cocoyl arginine, sodium N-cocoyl glutamate, sodium N-stearoyl glutamate, sodium N-cocoyl alanine, potassium N-cocoyl glycinate (gelled when mixed with terpene alcohol), sodium N-cocoyl arginine, sodium N-oleoyl glutamate, sodium N-oleoyl glutamate, sodium N-oleoylalanine, sodium N-oleoyl glycine, sodium N-oleoyl arginine, and sodium N-lauroyl arginine.

Instead of, or together with, the N-acylamino acid salt (the first aspect of the invention), a surface active agent selected from the group consisting of glycerin fatty acid esters, polyglycerin fatty acid esters, sucrose fatty acid esters, sorbitan fatty acid esters, and propylene glycol fatty acid esters may be used as a mixture with ethyl alcohol. This use comes from consideration for the burden on the environment and the safety in living beings. For the sucrose fatty acid ester, ethyl alcohol is not essential. Of these surface active agents, glycerin fatty acid esters, polyglycerin fatty acid esters, sucrose fatty acid esters, and sorbitan fatty acid esters are preferred. The surface active agent used in the present invention is safely metabolized in vivo, causes no protein denaturation, and does not inhibit enzymatic activity.

In the second or third aspect of the invention, a fatty acid alkylolamide or a sucrose fatty acid ester can be added as a thickner and a solubilization auxiliary to be used together with the N-acylamino acid salt. In this case, the fatty acid is one having 6 to 18 carbon atoms. The fatty acid for the sucrose fatty acid ester is preferably stearic acid, palmitic acid or oleic acid. Examples of the fatty acid alkylolamide are coconut fatty acid monoethanolamide, myristic acid monoethanolamide, myristic acid diethanolamide, lauric acid diethanolamide, and lauric acid monethanolamide. Preferred is coconut fatty acid diethanolamide. When the N-acylamino acid salt and coconut fatty acid monoethanolamide are concomitantly used to solubilize terpene alcohol, the resulting liquid is "a clear solution", regardless of the type of the amino acid.

According to the first aspect of the invention, the following substances may also be used instead of, or together with, the N-acylamino acid salt: fatty acid esters such as polyoxyethylene glyceryl fatty acid esters; polyoxyethylene sorbitan fatty acid esters, and polyoxyethylene sorbitol fatty acid esters; esters of petroleum-derived glycols, such as propylene glycol and polyethylene glycol, with fatty acids; fatty acid esters between fatty acids and polyethylene glycol as addition polymerization products between fatty alcohols and ethylene oxide, fatty acid alkylolamides such as $C_6$–$C_{18}$ fatty acid diethanolamides, and imidazoline-introduced products of fatty acids.

Along with the surface active agent used in the present invention, water-soluble alcohols, such as methyl alcohol, ethyl alcohol, propyl alcohol, isopropyl alcohol and hexyl alcohol, may be used where necessary. However, ethyl alcohol, which is a spirit, is preferred. The following substances with confirmed safety are also usable: water-soluble glycols, such as polyethylene glycol, propylene glycol, and butylene glycol; and polyols, such as glycerin, diglycerin, polyglycerin, sorbitol, glucose, fructose, mannose, xylose, trehalose, and sucrose. The above-mentioned alcohols, glycols, and polyols may be used in combination. It is also possible to add partially etherified products or partially esterified products of those alcohols, glycols, and polyols, mono-, di- or triethanolamine as ammonia-derived alcohols, or lecithin or saponin as a naturally occurring emulsifying agent. The amount of any of them is 0.1 to 15% by weight, preferably 0.25 to 10% by weight, based on the weight of the aqueous detergent composition as the first aspect of the present invention, in the case of the alcohols, glycols and polyols. According to the second or third aspect of the invention, ethyl alcohol can be used in an amount of 10 to 30% by weight, and the polyols in an amount of 10 to 30% by weight.

The enzymes that can be used in the first aspect of the invention are lipase, protease, amylase, and cellulose, which may be used singly or in combination. For dishwashing and laundry, lipase is mainly used. For body washing, protease is mainly used. The enzyme in the present invention can be used in an amount, based on the weight of the aqueous detergent composition, of 20 to 100 U/g (dry dirt) for lipase, 20 to 100 U/g (dry dirt) for amylase, and 20 to 100 U/g (dry dirt) for protease.

To the aqueous detergent composition of the present invention, a swelling agent for an object to be washed or for dirt itself, which swelling agent is selected from the group consisting of hydrogencarbonates, percarbonates, perborates, persulfates, hydrogenphosphates, and hydrogentartrates, may be added immediately before contact between the aqueous detergent composition and the object to be washed. Their examples include sodium percarbonate, sodium hydrogencarbonate, and sodium perborate. This swelling agent can be used in an amount of 0.1 to 10% by weight, preferably 0.5 to 5% by weight, based on the weight of the aqueous detergent composition as the first aspect of the invention. Based on the weight of the aqueous detergent composition as the second or third aspect of the invention, this swelling agent can be used in an amount of 0.1 to 30% by weight, preferably 0.5 to 15% by weight.

To the aqueous detergent composition as the first aspect of the invention , a citrate may also be added to facilitate th e uniform solubilization of the essential oils or their components. As the salt, sodium salt or potassium sa l t can be used, but sodium citrate is preferred. This substance permits solubilization even in hard water, and provides stability over time. Together with, or instead of, the citrate, there may be used malic acid or its salt, lactic acid or its salt, succinic acid or its salt, casein or its salt, sodium chloride, sorbic acid or its salt, polyphosphate, metaphosphate, disodium edetate, or calcium disodium ethylenediaminetetraacetate. From the viewpoint of preventing the over-fertilization of rivers and seas, the phosphoric acid or its salt is not preferred. With the assistance of the citrate or the like, the aqueous liquid state is ensured, and the viscosity is adjusted. At the same time, the citrate or the like reacts with the hydrogencarbonate or the like to cause foaming, thereby acting as a foaming agent in order to promote penetration into the object to be washed. Any of their organic acids, etc. can be used in an amount of 0.1 to 30% by weight, preferably 0.25 to 15% by weight, based on the weight of the aqueous detergent composition.

To the first aspect of the present invention, moreover, a pH adjustor may be added which is selected from the group consisting of organic acids, such as malic acid, citric acid, fumaric acid, and succinic acid, and carbonates, silicates and phosphates. The aqueous detergent composition of the present invention, in liquid form, is not restricted in pH, but preferably is weakly acidic to weakly alkaline. When an enzyme is contained in the invention, the pH may be such that the enzyme works effectively. This pH adjustor is used in an amount of 0.1 to 10% by weight, preferably 0.5 to 5% by weight, based on the weight of the aqueous detergent composition.

In the present invention, polysaccharides may be contained as auxiliaries. Examples of the polysaccharides are natural ones, such as guar gum, locust bean gum, quince seed, carrageenan, galactan, acacia gum, tragacanth gum, pectin, mannan, starch, xanthan gum, dextran, succinoglucan, cardolan, hyaluronic acid, and semisynthetic materials, such as methyl cellulose, ethyl cellulose, hydroxypropyl cellulose, hydroxyethyl cellulose, carboxymethyl cellulose, methylhydroxypropyl cellulose, sodium alginate, and propylene glycol alginate. Proteins such as gelatin, casein, albumin, and collagen can also be used. Other synthetic polymers include polyvinyl alcohol, polyvinyl pyrrolidone, polyvinyl methyl ether, carboxyvinyl polymer, and sodium polyacrylate. However, it is not clear whether they are safe when metabolized in vivo, and whether they inhibit enzyme activity. Thus, their use in the present invention is not preferred.

In the second or third aspect of the invention, moreover, a humectant, such as urea, pyrrolidonecarboxylic acid or its salt, may be added to promote the regeneration of the skin.

The present invention will now be described in detail by way of the following Examples, but it should not be interpreted that the invention is restricted thereby.

EXAMPLES

Example 1

To 50 ml of purified water in a 200 ml beaker, 1 g of linalool (an essential oil component), 10 g of Amilight (containing 30% by weight of triethanolamine N-cocoyl-DL-alanine; Ajinomoto Co., Inc.), and 0.1 g of pancreatin (a mixture of enzymes for protein digestion, starch digestion, and lipid digestion; Amano Pharmaceutical Co., Ltd.) were added. Further, purified water was added to make 100 ml of a clear aqueous detergent. A solidified form of lard (10 g) was taken into another 200 ml beaker, and the aqueous detergent was added. The mixture was stirred 10 times with a glass rod moved in circles. After the mixture was allowed to stand for 30 minutes, the state of dissolution of the lard was observed visually. The lard was completely uniformly solubilized. To confirm the state of dissolution further, the sample was cooled to 5° C., and observed again. The lard was in a finely divided form, and did not become solid again.

Example 2

The same procedure as in Example 1 was performed, except that pancreatin was replaced by 0.1 g of lipase OF (Amano Pharmaceutical). The lard finely divided upon decomposition lost its appearance completely. After cooling, the state of decomposition was observed visually. The finely divided lard was out of sight completely.

Example 3

The same procedure as in Example 1 was performed, except that linalool was replaced by α-terpineol. The resulting aqueous detergent was a clear liquid. The outcome was the same as in Example 1, and the lard was completely uniformly solubilized. After cooling, the lard was in a finely divided form, and did not become solid again.

Example 4

The same procedure as in Example 1 was performed, except that linalool was replaced by α-pinene. The resulting aqueous detergent was a gel. The outcome was the same as in Example 1, and the lard was nearly uniformly solubilized. After cooling, the lard was in a finely divided form, and did not become solid again.

Example 5

The same procedure as in Example 1 was performed, except that linalool was replaced by limonene. The resulting aqueous detergent was a gel. The outcome was the same as in Example 1, and the lard was nearly uniformly solubilized. After cooling, the lard was in a finely divided form, and did not become solid again.

Example 6

The same procedure as in Example 1 was performed, except that linalool was replaced by lavender. The resulting aqueous detergent was an emulsion. The outcome was the same as in Example 1, and the lard was considerably uniformly solubilized. After cooling, the lard was in a finely divided form, and did not become solid again.

Example 7

The same procedure as in Example 1 was performed, except that linalool was replaced by lemon oil. The resulting aqueous detergent was an opaque emulsion. The outcome was the same as in Example 1, and the lard was nearly uniformly solubilized. After cooling, the lard was in a finely divided form, and did not become solid again.

Example 8

The same procedure as in Example 1 was performed, except that linalool was replaced by hinokiol. The resulting aqueous detergent was an opaque emulsion. The outcome was the same as in Example 1, and the lard was nearly uniformly solubilized. After cooling, the lard was in a finely divided form, and did not become solid again.

Example 9

The same procedure as in Example 1 was performed, except that linalool was replaced by lemongrass. The resulting aqueous detergent was a translucent emulsion. The outcome was the same as in Example 1, and the lard was considerably uniformly solubilized. After cooling, the lard was in a finely divided form, and did not become solid again.

Example 10

The same procedure as in Example 1 was performed, except that linalool was replaced by eucalyptus. The resulting aqueous detergent was a clear liquid. The outcome was the same as in Example 1, and the lard was considerably uniformly solubilized. After cooling, the lard was in a finely divided form, and did not become solid again.

Example 11

The same procedure as in Example 1 was performed, except that linalool was replaced by rosemary. The resulting aqueous detergent was a clear liquid. The outcome was the same as in Example 1, and the lard was considerably uniformly solubilized. After cooling, the lard was in a finely divided form, and did not become solid again.

Example 12

The same procedure as in Example 1 was performed, except that linalool was replaced by orange oil. The resulting aqueous detergent was a cloudy emulsion. The outcome was the same as in Example 1, and the lard was nearly uniformly solubilized. After cooling, the lard was in a finely divided form, and did not become solid again.

Example 13

The same procedure as in Example 1 was performed, except that linalool was replaced by geraniol. The results are shown in Table 1.

Example 14

The same procedure as in Example 1 was performed, except that linalool was replaced by terpinen-4-ol. The results are shown in Table 1.

TABLE 1

| | Example | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| Linalool | 1.0 | 1.0 | | | | | | | | | | | | |
| α-terpineol | | | 1.0 | | | | | | | | | | | |
| Geraniol | | | | | | | | | | | | | 1.0 | |
| Terpinen-4-ol | | | | | | | | | | | | | | 1.0 |
| α-pinene | | | | 1.0 | | | | | | | | | | |
| α-limonene | | | | | 1.0 | | | | | | | | | |

TABLE 1-continued

| | Example | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| Lavender | | | | | | 1.0 | | | | | | | | |
| Lemon oil | | | | | | | 1.0 | | | | | | | |
| Hinokiol | | | | | | | | 1.0 | | | | | | |
| Lemongrass | | | | | | | | | 1.0 | | | | | |
| Eucalyptus | | | | | | | | | | 1.0 | | | | |
| Rosemary | | | | | | | | | | | 1.0 | | | |
| Orange oil | | | | | | | | | | | | 1.0 | | |
| Pancreatin | 0.1 | | 0.1 | 0.1 | 0.1 | 0.1 | 0.1 | 0.1 | 0.1 | 0.1 | 0.1 | 0.1 | 0.1 | 0.1 |
| Lipase OF | | 0.1 | | | | | | | | | | | | |
| Triethanolamine | 3.0 | 5.0 | 3.0 | 3.0 | 3.0 | 3.0 | 7.0 | 3.0 | 3.0 | 3.0 | 10.0 | 3.0 | 3.0 | 3.0 |
| N-cocoyl-DL-alanine | | | | | | | | | | | | | | |
| State of aqueous liquid without addition of lard | CT | CT | CT | GL | GL | CT | FT | FT | HT | CT | CT | FT | T | T |
| State of lard in aqueous liquid after being allowed to stand for 30 min | AAA | AAA | AAA | AAa | AAa | AAa | AAa | AAa | AAa | AAa | AAa | AAa | AAA | AAA |

State of aqueous liquid
CT: clear
T: nearly clear
HT: translucent
FT: opaque emulsion
SL: sol
GL: gel
CL: cream State of lard:
AAA: completely uniformly dissolved and decomposed
AAa: nearly uniformly dissolved and decomposed
AA: nonuniformly dissolved and decomposed
A: insufficiently dissolved and decomposed
X: not dissolved or decomposed Example 15

The same procedure as in Example 3 was performed, except that pancreatin was replaced by 0.1 g of lipase OF. The results are shown in Table 2.

Example 16

The same procedure as in Example 13 was performed, except that pancreatin was replaced by 0.1 g of lipase OF. The results are shown in Table 2.

Example 17

The same procedure as in Example 14 was performed, except that pancreatin was replaced by 0.1 g of lipase OF. The results are shown in Table 2.

Example 18

The same procedure as in Example 4 was performed, except that pancreatin was replaced by 0.1 g of lipase OF. The results are shown in Table 2.

Example 19

The same procedure as in Example 5 was performed, except that pancreatin was replaced by 0.1 g of lipase OF. The results are shown in Table 2.

Example 20

The same procedure as in Example 6 was performed, except that pancreatin was replaced by 0.1 g of lipase OF. The results are shown in Table 2.

Example 21

The same procedure as in Example 7 was performed, except that pancreatin was replaced by 0.1 g of lipase OF. The results are shown in Table 2.

Example 22

The same procedure as in Example 8 was performed, except that pancreatin was replaced by 0.1 g of lipase OF. The results are shown in Table 2.

Example 23

The same procedure as in Example 9 was performed, except that pancreatin was replaced by 0.1 g of lipase OF. The results are shown in Table 2.

Example 24

The same procedure as in Example 10 was performed, except that pancreatin was replaced by 0.1 g of lipase OF. The results are shown in Table 2.

Example 25

The same procedure as in Example 11 was performed, except that pancreatin was replaced by 0.1 g of lipase OF. The results are shown in Table 2.

Example 26

The same procedure as in Example 12 was performed, except that pancreatin was replaced by 0.1 g of lipase OF. The results are shown in Table 2.

TABLE 2

| | Example | | | | | | | | | | | |
|---|---|---|---|---|---|---|---|---|---|---|---|---|
| | 15 | 16 | 17 | 18 | 19 | 20 | 21 | 22 | 23 | 24 | 25 | 26 |
| Linalool | | | | | | | | | | | | |
| α-terpineol | 1.0 | | | | | | | | | | | |
| Geraniol | | 1.0 | | | | | | | | | | |
| Terpinen-4-ol | | | 1.0 | | | | | | | | | |
| α-pinene | | | | 1.0 | | | | | | | | |
| α-limonene | | | | | 1.0 | | | | | | | |
| Lavender | | | | | | 1.0 | | | | | | |
| Lemon oil | | | | | | | 1.0 | | | | | |
| Hinokiol | | | | | | | | 1.0 | | | | |
| Lemongrass | | | | | | | | | 1.0 | | | |
| Eucalyptus | | | | | | | | | | 1.0 | | |
| Rosemary | | | | | | | | | | | 1.0 | |
| Orange oil | | | | | | | | | | | | 1.0 |
| Lipase OF | 0.1 | 0.1 | 0.1 | 0.1 | 0.1 | 0.1 | 0.1 | 0.1 | 0.1 | 0.1 | 0.1 | 0.1 |
| Triethanolamine | 8.0 | 3.0 | 3.0 | 3.0 | 3.0 | 3.0 | 3.0 | 3.0 | 11.0 | 3.0 | 3.0 | 3.0 |
| N-cocoyl-DL-alanine | | | | | | | | | | | | |
| State of aqueous liquid without addition of lard | CT | T | T | GL | GL | CT | FT | FT | HT | CT | CT | FT |
| State of lard in aqueous liquid after being allowed to stand for 30 min | AAA | AAA | AAA | AAa | AAa | AAa | AAa | AAa | AAa | AAa | AAa | AAa |

Example 27

To 50 ml of purified water in a 200 ml beaker, 5.0 g of linalool (an essential oil component), 10 g of sodium N-stearoyl-L-glutamate, and 0.1 g of lipase OF were added. Further, purified water was added to make 100 ml of a creamy aqueous detergent. A solidified form of lard (10 g) was taken into another 200 ml beaker, and the aqueous detergent was added. The mixture was stirred 10 times with a glass rod moved in circles. After the mixture was allowed to stand for 30 minutes, the state of dissolution of the lard was observed visually. The lard was completely uniformly solubilized. To confirm the state of dissolution further, the sample was cooled to 5° C., and observed again. The lard was in a finely divided form, and did not become solid again.

Example 28

The same procedure as in Example 27 was performed, except that 5.0 g of linalool was replaced by 4.0 g of α-terpineol, and 0.1 g of lipase OF was replaced by 0.1 g of pancreatin. The results are shown in Table 3.

Example 29

The same procedure as in Example 27 was performed, except that 5.0 g of linalool was replaced by 3.0 g of geraniol. The results are shown in Table 3.

Example 30

The same procedure as in Example 27 was performed, except that 5.0 g of linalool was replaced by 1.0 g of terpinen-4-ol, and 0.1 g of lipase OF was replaced by 0.1 g of pancreatin. The results are shown in Table 3.

Example 31

The same procedure as in Example 27 was performed, except that 5.0 g of linalool was replaced by 3.0 g of α-pinene. The results are shown in Table 3.

Example 32

The same procedure as in Example 27 was performed, except that 5.0 g of linalool was replaced by 3.0 g of limonene, and 0.1 g of lipase OF was replaced by 0.1 g of pancreatin. The results are shown in Table 3.

Example 33

The same procedure as in Example 27 was performed, except that 5.0 g of linalool was replaced by 1.0 g of lavender. The results are shown in Table 3.

Example 34

The same procedure as in Example 27 was performed, except that 5.0 g of linalool was replaced by 1.0 g of lemon oil, and 0.1 g of lipase OF was replaced by 0.1 g of pancreatin. The results are shown in Table 3.

Example 35

The same procedure as in Example 27 was performed, except that 5.0 g of linalool was replaced by 1.0 g of hinokiol. The results are shown in Table 3.

Example 36

The same procedure as in Example 27 was performed, except that 5.0 g of linalool was replaced by 1.0 g of lemongrass, and 0.1 g of lipase OF was replaced by 0.1 g of pancreatin. The results are shown in Table 3.

Example 37

The same procedure as in Example 27 was performed, except that 5.0 g of linalool was replaced by 1.0 g of eucalyptus. The results are shown in Table 3.

Example 38

The same procedure as in Example 27 was performed, except that 5.0 g of linalool was replaced by 1.0 g of rosemary, and 0.1 g of lipase OF was replaced by 0.1 g of pancreatin. The results are shown in Table 3.

Example 39

The same procedure as in Example 27 was performed, except that 5.0 g of linalool was replaced by 3.0 g of orange oil. The results are shown in Table 3.

TABLE 3

| | Example | | | | | | | | | | | | |
|---|---|---|---|---|---|---|---|---|---|---|---|---|---|
| | 27 | 28 | 29 | 30 | 31 | 32 | 33 | 34 | 35 | 36 | 37 | 38 | 39 |
| Linalool | 5.0 | | | | | | | | | | | | |
| α-terpineol | | 4.0 | | | | | | | | | | | |
| Geraniol | | | 3.0 | | | | | | | | | | 1.0 |
| Terpinen-4-ol | | | | 1.0 | | | | | | | | | |
| α-pinene | | | | | 3.0 | | | | | | | | |
| α-limonene | | | | | | 3.0 | | | | | | | |
| Lavender | | | | | | | 1.0 | | | | | | |
| Lemon oil | | | | | | | | 1.0 | | | | | |
| Hinokiol | | | | | | | | | 1.0 | | | | |
| Lemongrass | | | | | | | | | | 1.0 | | | |
| Eucalyptus | | | | | | | | | | | 1.0 | | |
| Rosemary | | | | | | | | | | | | 1.0 | |
| Orange oil | | | | | | | | | | | | | 3.0 |
| Pancreatin | | 0.1 | | 0.1 | | 0.1 | | 0.1 | | 0.1 | | 0.1 | |
| Lipase OF | 0.1 | | 0.1 | | 0.1 | | 0.1 | | 0.1 | | 0.1 | | 0.1 |
| Sodium N-stearoyl-L-glutamate | 10.0 | 10.0 | 10.0 | 10.0 | 10.0 | 10.0 | 10.0 | 10.0 | 10.0 | 10.0 | 10.0 | 10.0 | 10.0 |
| State of aqueous liquid without addition of lard | CL | CL | CL | CL | CL | CL | CL | CL | CL | CL | CL | CL | CL |
| State of lard in aqueous liquid after being allowed to stand for 30 min | AAA | AAA | AAA | AAA | AAA | AAA | AAa | AAa | AAa | AAa | AAa | AAa | AAA |

Example 40

To 50 ml of purified water in a 200 ml beaker, 3.0 g of linalool (an essential oil component), 10 g of triethanolamine N-lauroyl-L-glutamate, and 0.1 g of lipase OF were added. Further, purified water was added to make 100 ml of a completely clear aqueous detergent. A solidified form of lard (10 g) was taken into another 200 ml beaker, and the aqueous detergent was added. The mixture was stirred 10 times with a glass rod moved in circles. After the mixture was allowed to stand for 30 minutes, the state of dissolution of the lard was observed visually. The lard was completely uniformly solubilized. To confirm the state of dissolution further, the sample was cooled to 5° C., and observed again. The lard was in a finely divided form, and did not become solid again.

Example 41

The same procedure as in Example 40 was performed, except that 3.0 g of linalool was replaced by 2.0 g of α-terpineol, and 0.1 g of lipase OF was replaced by 0.1 g of pancreatin. The results are shown in Table 4.

Example 42

The same procedure as in Example 40 was performed, except that 3.0 g of linalool was replaced by 1.0 g of geraniol. The results are shown in Table 4.

Example 43

The same procedure as in Example 40 was performed, except that 3.0 g of linalool was replaced by 1.0 g of terpinen-4-ol, and 0.1 g of lipase OF was replaced by 0.1 g of pancreatin. The results are shown in Table 4.

Example 44

The same procedure as in Example 40 was performed, except that 3.0 g of linalool was replaced by 3.0 g of α-pinene. The results are shown in Table 4.

Example 45

The same procedure as in Example 40 was performed, except that 3.0 g of linalool was replaced by 3.0 g of limonene, and 0.1 g of lipase OF was replaced by 0.1 g of pancreatin. The results are shown in Table 4.

Example 46

The same procedure as in Example 40 was performed, except that 3.0 g of linalool was replaced by 1.0 g of lavender. The results are shown in Table 4.

Example 47

The same procedure as in Example 40 was performed, except that 3.0 g of linalool was replaced by 1.0 g of lemon oil, and 0.1 g of lipase OF was replaced by 0.1 g of pancreatin. The results are shown in Table 4.

Example 48

The same procedure as in Example 40 was performed, except that 3.0 g of linalool was replaced by 1.0 g of hinokiol. The results are shown in Table 4.

Example 49

The same procedure as in Example 40 was performed, except that 3.0 g of linalool was replaced by 1.0 g of lemongrass, and 0.1 g of lipase OF was replaced by 0.1 g of pancreatin. The results are shown in Table 4.

Example 50

The same procedure as in Example 40 was performed, except that 3.0 g of linalool was replaced by 1.0 g of eucalyptus. The results are shown in Table 4.

Example 51

The same procedure as in Example 40 was performed, except that 3.0 g of linalool was replaced by 1.0 g of rosemary, and 0.1 g of lipase OF was replaced by 0.1 g of pancreatin. The results are shown in Table 4.

Example 52

The same procedure as in Example 40 was performed, except that 3.0 g of linalool was replaced by 3.0 g of orange oil. The results are shown in Table 4.

TABLE 4

| | Example | | | | | | | | | | | | |
|---|---|---|---|---|---|---|---|---|---|---|---|---|---|
| | 40 | 41 | 42 | 43 | 44 | 45 | 46 | 47 | 48 | 49 | 50 | 51 | 52 |
| Linalool | 3.0 | | | | | | | | | | | | |
| α-terpineol | | 2.0 | | | | | | | | | | | |
| Geraniol | | | 1.0 | | | | | | | | | | 1.0 |
| Terpinen-4-ol | | | | 1.0 | | | | | | | | | |
| α-pinene | | | | | 3.0 | | | | | | | | |
| α-limonene | | | | | | 3.0 | | | | | | | |
| Lavender | | | | | | | 1.0 | | | | | | |
| Lemon oil | | | | | | | | 1.0 | | | | | |
| Hinokiol | | | | | | | | | 1.0 | | | | |
| Lemongrass | | | | | | | | | | 1.0 | | | |
| Eucalyptus | | | | | | | | | | | 1.0 | | |
| Rosemary | | | | | | | | | | | | 1.0 | |
| Orange oil | | | | | | | | | | | | | 3.0 |
| Pancreatin | | 0.1 | | 0.1 | | 0.1 | | 0.1 | | 0.1 | | 0.1 | |
| Lipase OF | 0.1 | | 0.1 | | 0.1 | | 0.1 | | 0.1 | | 0.1 | | 0.1 |
| Triethanolamine N-lauroyl-L-glutamate | 10.0 | 10.0 | 10.0 | 10.0 | 10.0 | 10.0 | 10.0 | 10.0 | 10.0 | 10.0 | 10.0 | 10.0 | 10.0 |
| State of aqueous liquid without addition of lard | CT | CT | CT | CT | FT | FT | HT | HT | FT | HT | CT | CT | HT |
| State of lard in aqueous liquid after being allowed to stand for 30 min | AAA | AAA | AAA | AAA | AA | AA | AAa | AAa | AAa | AAa | AAa | AAa | AAA |

Example 53

To 50 ml of purified water in a 200 ml beaker, 1.0 g of linalool (an essential oil component), 3.0 g of sodium N-cocoyl-L-glutamate, and 0.1 g of pancreatin were added. Further, purified water was added to make 100 ml of a nearly clear aqueous detergent. A solidified form of lard (10 g) was taken into another 200 ml beaker, and the aqueous detergent was added. The mixture was stirred 10 times with a glass rod moved in circles. After the mixture was allowed to stand for 30 minutes, the state of dissolution of the lard was observed visually. The lard was completely uniformly solubilized. To confirm the state of dissolution further, the sample was cooled to 5° C., and observed again. The lard was in a finely divided form, and did not become solid again.

Example 54

The same procedure as in Example 53 was performed, except that 1.0 g of linalool was replaced by 1.0 g of α-terpineol, and 0.1 g of pancreatin was replaced by 0.1 g of lipase OF. The results are shown in Table 5.

Example 55

The same procedure as in Example 53 was performed, except that 1.0 g of linalool was replaced by 1.0 g of α-pinene. The results are shown in Table 5.

Example 56

The same procedure as in Example 53 was performed, except that 1.0 g of linalool was replaced by 1.0 g of orange oil, and 0.1 g of pancreatin was replaced by 0.1 g of lipase OF. The results are shown in Table 5.

Example 57

To 50 ml of purified water in a 200 ml beaker, 1.0 g of linalool (an essential oil component), 5.0 g of potassium N-cocoacyl-L-glutamate, and 0.1 g of pancreatin were added. Further, purified water was added to make 100 ml of a clear aqueous detergent. A solidified form of lard (10 g) was taken into another 200 ml beaker, and the aqueous detergent was added. The mixture was stirred 10 times with a glass rod moved in circles. After the mixture was allowed to stand for 30 minutes, the state of dissolution of the lard was observed visually. The lard was completely uniformly solubilized. To confirm the state of dissolution further, the sample was cooled to 5° C., and observed again. The lard was in a finely divided form, and did not become solid again.

Example 58

The same procedure as in Example 57 was performed, except that 1.0 g of linalool was replaced by 1.0 g of α-terpineol, and 0.1 g of pancreatin was replaced by 0.1 g of lipase OF. The results are shown in Table 5.

Example 59

To 50 ml of purified water in a 200 ml beaker, 1.0 g of linalool (an essential oil component), 5.0 g of potassium N-lauroyl-L-glutamate, and 0.1 g of pancreatin were added. Further, purified water was added to make 100 ml of a clear aqueous detergent. A solidified form of lard (10 g) was taken into another 200 ml beaker, and the aqueous detergent was added. The mixture was stirred 10 times with a glass rod moved in circles. After the mixture was allowed to stand for 30 minutes, the state of dissolution of the lard was observed visually. The lard was completely uniformly solubilized. To confirm the state of dissolution further, the sample was cooled to 5° C., and observed again. The lard was in a finely divided form, and did not become solid again.

Example 60

The same procedure as in Example 59 was performed, except that 1.0 g of linalool was replaced by 1.0 g of α-terpineol, and 0.1 g of pancreatin was replaced by 0.1 g of lipase OF. The results are shown in Table 5.

Example 61

To 50 ml of purified water in a 200 ml beaker, 1.0 g of linalool (an essential oil component), 5.0 g of sodium N-cocoyl sarcosinate, and 0.1 g of pancreatin were added. Further, purified water was added to make 100 ml of a clear aqueous detergent. A solidified form of lard (10 g) was taken into another 200 ml beaker, and the aqueous detergent was added. The mixture was stirred 10 times with a glass rod moved in circles. After the mixture was allowed to stand for 30 minutes, the state of dissolution of the lard was observed visually. The lard was completely uniformly solubilized. To confirm the state of dissolution further, the sample was cooled to 5° C., and observed again. The lard was in a finely divided form, and did not become solid again.

Example 62

The same procedure as in Example 61 was performed, except that 1.0 g of linalool was replaced by 1.0 g of α-terpineol, and 0.1 g of pancreatin was replaced by 0.1 g of lipase OF. The results are shown in Table 5.

Example 63

To 50 ml of purified water in a 200 ml beaker, 1.0 g of linalool (an essential oil component), 5.0 g of triethanolamine lauroyl sarcosinate, and 0.1 g of pancreatin were added. Further, purified water was added to make 100 ml of a clear aqueous detergent. A solidified form of lard (10 g) was taken into another 200 ml beaker, and the aqueous detergent was added. The mixture was stirred 10 times with a glass rod moved in circles. After the mixture was allowed to stand for 30 minutes, the state of dissolution of the lard was observed visually. The lard was completely uniformly solubilized. To confirm the state of dissolution further, the sample was cooled to 5° C., and observed again. The lard was in a finely divided form, and did not become solid again.

Example 64

The same procedure as in Example 63 was performed, except that 1.0 g of linalool was replaced by 1.0 g of α-terpineol, and 0.1 g of pancreatin was replaced by 0.1 g of lipase OF. The results are shown in Table 5.

TABLE 5

| | Example | | | | | | | | | | | |
|---|---|---|---|---|---|---|---|---|---|---|---|---|
| | 53 | 54 | 55 | 56 | 57 | 58 | 59 | 60 | 61 | 62 | 63 | 64 |
| Linalool | 1.0 | | | | 1.0 | | 1.0 | | 1.0 | | 1.0 | |
| α-terpineol | | 1.0 | | | | | | | | | | |
| α-pinene | | | 1.0 | | | | | | | | | |
| Orange oil | | | | 1.0 | | | | | | | | |
| Pancreatin | 0.1 | | 0.1 | | 0.1 | | 0.1 | | 0.1 | | 1.0 | |
| Lipase OF | | 0.1 | | 0.1 | | 0.1 | | 0.1 | | 0.1 | | 0.1 |
| Sodium N-cocoyl-L-glutamate | 3.0 | 3.0 | 3.0 | 3.0 | | | | | | | | |
| Potassium N-cocoacyl-L-glutamate | | | | | 5.0 | 5.0 | | | | | | |
| Potassium N-lauroyl-L-glutamate | | | | | | | 5.0 | 5.0 | | | | |
| Sodium N-cocoyl sarcosinate | | | | | | | | | 5.0 | 5.0 | | |
| Triethanolamine lauroyl sarcosinate | | | | | | | | | | | 5.0 | 5.0 |
| State of aqueous liquid without addition of lard | T | T | FT | HT | CT | CT | CT | CT | CT | CT | CT | CT |
| State of lard in aqueous liquid after being allowed to stand for 30 min | AAA | AAA | AAA | AAA | AAA | AAA | AAA | AAA | AAA | AAA | AAA | AAA |

Example 65

To 50 ml of purified water in a 200 ml beaker, 1.0 g of linalool (an essential oil component), 3.0 g of DK Ester (a product of Dai-ichi Kogyo Seiyaku Co., Ltd.; containing 35% of sucrose fatty acid ester), and 0.1 g of pancreatin were added. Further, purified water was added to make 100 ml of a sol-form aqueous detergent. A solidified form of lard (10 g) was taken into another 200 ml beaker, and the aqueous detergent was added. The mixture was stirred 10 times with a glass rod moved in circles. After the mixture was allowed to stand for 30 minutes, the state of dissolution of the lard was observed visually. The lard was completely uniformly solubilized. To confirm the state of dissolution further, the sample was cooled to 5° C., and observed again. The lard was in a finely divided form, and did not become solid again.

Example 66

The same procedure as in Example 65 was performed, except that 1.0 g of linalool was replaced by 1.0 g of α-terpineol, and 0.1 g of pancreatin was replaced by 0.1 g of lipase OF. The results are shown in Table 6.

Example 67

The same procedure as in Example 65 was performed, except that 1.0 g of linalool was replaced by 1.0 g of α-pinene. The results are shown in Table 6.

Example 68

The same procedure as in Example 65 was performed, except that 1.0 g of linalool was replaced by 1.0 g of orange oil, and 0.1 g of pancreatin was replaced by 0.1 g of lipase OF. The results are shown in Table 6.

Example 69

To 50 ml of purified water in a 200 ml beaker, 1.0 g of linalool (an essential oil component), 5.0 g of polyglyceryl fatty acid ethyl ester, and 0.1 g of pancreatin were added. Further, purified water was added to make 100 ml of a sol-form aqueous detergent. A solidified form of lard (10 g) was taken into another 200 ml beaker, and the aqueous detergent was added. The mixture was stirred 10 times with a glass rod moved in circles. After the mixture was allowed to stand for 30 minutes, the state of dissolution of the lard was observed visually. The lard was completely uniformly solubilized. To confirm the state of dissolution further, the sample was cooled to 5° C., and observed again. The lard was in a finely divided form, and did not become solid again.

Example 70

The same procedure as in Example 69 was performed, except that 1.0 g of linalool was replaced by 1.0 g of α-terpineol, and 0.1 g of pancreatin was replaced by 0.1 g of lipase OF. The results are shown in Table 6.

Example 71

To 50 ml of purified water in a 200 ml beaker, 1.0 g of linalool (an essential oil component), 3.0 g of coconut fatty acid diethanolamide, and 0.1 g of pancreatin were added. Further, purified water was added to make 100 ml of a sol-form aqueous detergent. A solidified form of lard (10 g) was taken into another 200 ml beaker, and the aqueous detergent was added. The mixture was stirred 10 times with a glass rod moved in circles. After the mixture was allowed to stand for 30 minutes, the state of dissolution of the lard was observed visually. The lard was completely uniformly solubilized. To confirm the state of dissolution further, the sample was cooled to 5° C., and observed again. The lard was in a finely divided form, and did not become solid again.

Example 72

The same procedure as in Example 71 was performed, except that 1.0 g of linalool was replaced by 1.0 g of α-terpineol, and 0.1 g of pancreatin was replaced by 0.1 g of lipase OF. The results are shown in Table 6.

Example 73

The same procedure as in Example 71 was performed, except that 1.0 g of linalool was replaced by 1.0 g of α-pinene. The results are shown in Table 6.

Example 74

The same procedure as in Example 71 was performed, except that 1.0 g of linalool was replaced by 1.0 g of orange oil, and 0.1 g of pancreatin was replaced by 0.1 g of lipase OF. The results are shown in Table 6.

Example 75

To 50 ml of purified water in a 200 ml beaker, 1.0 g of linalool (an essential oil component), 3.0 g of cocoyl imidazoline betaine, and 0.1 g of pancreatin were added. Further, purified water was added to make 100 ml of a clear aqueous detergent. A solidified form of lard (10 g) was taken into another 200 ml beaker, and the aqueous detergent was added. The mixture was stirred 10 times with a glass rod moved in circles. After the mixture was allowed to stand for 30 minutes, the state of dissolution of the lard was observed visually. The lard was completely uniformly solubilized. To confirm the state of dissolution further, the sample was cooled to 5° C., and observed again. The lard was in a finely divided form, and did not become solid again.

Example 76

The same procedure as in Example 75 was performed, except that 1.0 g of linalool was replaced by 1.0 g of α-pinene, and 0.1 g of pancreatin was replaced by 0.1 g of lipase OF. The results are shown in Table 6.

TABLE 6

| | Example | | | | | | | | | | | |
|---|---|---|---|---|---|---|---|---|---|---|---|---|
| | 65 | 66 | 67 | 68 | 69 | 70 | 71 | 72 | 73 | 74 | 75 | 76 |
| Linalool | 1.0 | | | | 1.0 | | 1.0 | | | | 1.0 | |
| α-terpineol | | 1.0 | | | | 1.0 | | 1.0 | | | | |
| α-pinene | | | 1.0 | | | | | | 1.0 | | | 1.0 |
| Orange oil | | | | 1.0 | | | | | | 1.0 | | |
| Pancreatin | 0.1 | | 0.1 | 0.1 | 0.1 | | 0.1 | | 0.1 | | 0.1 | |
| Lipase OF | | 0.1 | | | | 0.1 | | 0.1 | | 0.1 | | 0.1 |
| Sucrose fatty acid ester | 3.0 | 3.0 | 3.0 | 3.0 | | | | | | | | |
| Polyglyceryl fatty acid ethyl ester | | | | | 5.0 | 5.0 | | | | | | |
| Coconut fatty acid diethanolamide | | | | | | | 3.0 | 3.0 | 3.0 | 3.0 | | |
| Cocoyl imidazoline betaine | | | | | | | | | | | 3.0 | 3.0 |
| State of aqueous liquid without addition of lard | SL | SL | SL | SL | SL | SL | SL | SL | FT | FT | CT | CT |
| State of lard in aqueous liquid after being allowed to stand for 30 min | AAA | AAA | AAA | AAA | AAA | AAA | AAA | AAA | AAA | AAA | AAA | AAA |

Comparative Example 1

The same procedure as in Example 1 was performed, except that pinene was replaced by a commercially available kitchen detergent (Mamalemon, Lion Corp.; surfactant content 30%) in an amount corresponding to 1 ml of a surface active agent. After the sample was allowed to stand for 30 minutes, the lard remained solidified. After the sample was stored in the refrigerator for 60 minutes, the lard was partly solidified.

Comparative Example 2

The same procedure as in Example 1 was repeated, except that neither pinene nor sodium N-cocoyl-L-glutamate was added (that is, only the enzyme was added). After the sample was allowed to stand for 30 minutes, the lard remained solidified. After the sample was stored in the refrigerator for 60 minutes, the lard was partly solidified.

The results of Examples 1 to 76 and Comparative Examples 1 to 2 were summarized as follows: In the presence of essential oils, or essential oil components isolated therefrom, lard was solubilized in finely divided form, and did not solidify, although the results were slightly different. When an enzyme was incorporated, lard was further finely divided. With a conventional kitchen detergent, the fine division rate was low. When only an enzyme was present, lard remained solidified.

Example 77

Edible lard (3 g), 3 g of mayonnaise (Q.P. Corp.), 3 ml of soy sauce (KIKKOMAN CORP.), and 3 g of gelatin were mixed and stirred in this order. The mixture was applied to the sleeve, cuff and neck of a shirt weighing 400 g. Then, the thus stained shirt was washed for 10 minutes in a washing machine using 10 ml of the detergent of the present invention that had the composition shown in Table 7. A single rinse was enough to remove the dirt completely. The net amount of the surface active agent used was as small as 0.2 g.

Example 78

The same procedure as in Example 77 was performed, except that the below-mentioned detergent for fiber products was used. A formulation containing it is shown in Table 7.

Example 79

The same procedure as in Example 78 was performed, except that 0.1 g of cationic cellulose was further added. A formulation containing it is shown in Table 7.

Comparative Example 3

The same procedure as in Example 77 was repeated, except that 2.3 g of a commercially available pure soap detergent (Consumers' Cooperatives Association; fatty acid sodium salt with a pure soap content of 60%) was used instead of the detergent of Example 77 (α-pinene, DK Ester, and Amisoft). Two rinses were required, but the dirt was removed completely in 10 minutes. The amount of the surface active agent used was 1.38 g, 6.9 times the amount used in the present invention (Example 77).

Comparative Example 4

The same procedure as in Example 77 was repeated, except that 2.3 g of a commercially available washing detergent (a product of Lion Corp., trade name: Top, components: α-sulfonic acid fatty acid ester sodium salt, straight chain alkylbenzene, and fatty acid sodium salt as surface active agents (34%), and aluminosilicate, carbonate, enzyme, and fluorescent agent as auxiliaries) was used instead of the detergent of Example 77 (α-pinene, DK Ester, and Amisoft). Two rinses were required, but the dirt was removed completely in 10 minutes. The amount of the surface active agent used was 0.69 g, 3.45 times the amount used in the present invention (Example 77).

Example 80

The formulation of this Example in Table 7 was used as a bath detergent.

Example 81

The formulation of this Example in Table 7 was used as a bath cream for foot.

Comparative Example 5

The formulation of this Comparative Example in Table 7 was used as a dishwashing detergent.

TABLE 7

| | Example | | | | | Comparative Example |
|---|---|---|---|---|---|---|
| | 77 | 78 | 79 | 80 | 81 | 5 |
| α-pinene | 1.0 | | | | | |
| α-terpineol | | 1.0 | 1.0 | | | |
| Tea-tree oil | | | | 1.0 | 15.0 | |
| Linalool | | | | | | 1.0 |
| Sodium hydrogencarbonate | 10 | 10 | 10 | | | |
| Sodium citrate | 10 | 10 | 10 | 20 | | |
| Xanthan gum | | | | 0.5 | | |
| Cationic cellulose | | | 0.1 | | | |
| Glycerin | | | | 1.0 | 1.0 | |
| Lipase | 1000 u | 1000 u | 1000 u | | | 1000 u |
| Amylase | 300 u | 300 u | 300 u | | | 300 u |
| Protease | 300 u | 300 u | 300 u | 100 u | 1000 u | 300 u |
| DK Ester (Dai-ichi Kogyo Seiyaku, containing 35% sucrose fatty acid ester) | 4 | | | | | |
| Amilight ACT-12 (Ajinomoto, containing 30 wt. % triethanolamine N-cocoyl-DL-alanine) | | 9.0 | 9.0 | 9.0 | | 20.0 |
| Amisoft CT-12 (Ajinomoto, containing 30% triethanolamine N-cocoyl-L-glutamate) | 2 | | | | | |
| Amisoft HS-11 (Ajinomoto, sodium N-stearoyl-L-glutamate) | | | | | 20.0 | |
| Rice bran soap | | | | | | 61% |
| Fresh Lime (neutral synthetic detergent, Nissan) | | | | | | 20% |
| Charmy Compact (Lion) | | | | | | 37% |
| Total (ml) | 100 | 100 | 100 | 100 | 100 | 100 |

Examples 82 to 92

Environment safeguarding dishwashing detergent compositions and home care product washing detergent compositions having formulations shown in Table 8 (the figures in the table are in gram) were prepared. Each composition was in an amount of 100 ml upon addition of water.

(i) Objects to be washed

Corresponding to the following items (1) to (17):

(1) For tableware and vegetables.

(2) Washing of oil in heating instruments, such as electric oven, fryer, gas oven, cooker, and griddle; drainage and exhaust equipment; and air fan, duct, filter (3) microbial elimination and cleaning of kitchen utensils, such as chopping board, rice washer, vegetable slicer, and sink (4) Interior cleaning of storage devices, such as refrigerator, freezer, and cold table (5) Exterior of stainless steel implements, tile in floor and wall (6) Rigid-surface articles, such as counter, table and chair, and glass (7) Sanitary ware, such as wash basin and toilet bowl or urinal (8) Steel furniture, such as office supplies (9) Instruments incorporating electric appliances, such as OA devices, television set, and electric oven

(10) Leather goods, such as sofa

(11) Board or cloth-hanged wall

(12) Removal of dirt on carpet

(13) Cleaning of bathtub, wall or floor made of plastic or porcelain enamel

(14) Interior fixtures in automobiles

(15) Metallic or chemical conversion tools

(16) Dishwashing by automatic dishwashers

(17) Washing of drainage pipe (ii) Evaluation methods

The detergent compositions were tested at ordinary houses, offices and restaurants, and evaluated in accordance with the following methods of evaluation:

(a) For evaluation of a skin chap due to manual dishwashing, the detergent composition was used for 30 days by 30 persons with abnormalities such as atopic dermatitis or housewives' eczema, and then the number of persons who complained of abnormalities was recorded.

(b) For evaluation of detergency, 10 panelists used the detergent composition, and evaluated it on a scale of 3 categories, good (○), ordinary (Δ), and poor (×). The category that was adopted most frequently in evaluation was recorded.

(c) For evaluation of hand roughening, the above panelists did work using the detergent composition without wearing rubber gloves, and evaluated the degree of hand roughening by the following categories: Did not occur (○), Slightly occurred (Δ), Occurred severely (×). The category that was adopted most frequently in evaluation was recorded. In Examples 82, 85 and 88, the amounts of the surface active agents were small, and about 15 to 40% of those of conventional products.

TABLE 8

| | Example | | | | | | | | | | |
|---|---|---|---|---|---|---|---|---|---|---|---|
| | 82 | 83 | 84 | 85 | 86 | 87 | 88 | 89 | 90 | 91 | 92 |
| Dipotassium N-cocoacyl-L-glutamate | | | | | | | | | | 6.0 | 0.6 |
| Triethanolamine | 9.0 | 2.25 | 1.125 | 6.0 | 1.5 | 0.75 | 6.0 | 1.5 | 0.75 | | |
| N-cocoyl-DL-alanine | | | | | | | | | | | |
| Coconut fatty acid diethanolamide | | | | | | | 2.0 | 0.5 | 0.25 | | |
| Sucrose fatty acid ester | | | | 2.0 | 0.5 | 0.25 | | | | | |
| Linalool | 2.0 | 0.5 | 0.25 | | | | | | | | |
| Pinene | | | | 1.0 | 0.25 | 0.125 | | | | | |
| Linalyl acetate | | | | | | | 1.0 | 0.25 | 0.125 | | |
| Terpineol | | | | | | | | | | 2.0 | 0.2 |
| Sodium alginate | 0.2 | 0.05 | 0.025 | | | | | | | | |
| Glycerin | | | | 1.0 | 0.25 | 0.125 | 1.0 | 0.25 | 0.125 | 2.0 | 0.2 |
| Urea | | | | 2.0 | 0.5 | 0.25 | 2.0 | 0.5 | 0.25 | | |
| pH | 6.2 | | | 6.6 | | | 5.4 | | | 5.4 | |
| Object to be washed | (1) | (2)(3)(4)(5)(12)(13)(14) | (9)(10)(11) | (1) | (2)(3)(4)(5)(7) | (6)(8) | (1) | (2)(3)(4)(5)(7) | (6)(8) | (1) | (16) |
| Skin chap due to manual dishwashing | 0 | — | — | 0 | — | — | 0 | — | — | 0 | — |
| Ordinary houses | | | | | | | | | | | |
| Detergency/hand roughening | — | ○/○ | ○/○ | — | — | | | | | ○/○ | ○/○ |
| Offices | | | | | | | | | | | |
| Detergency/hand roughening | — | ○/○ | ○/○ | — | ○/○ | ○/○ | — | ○/○ | ○/○ | — | — |
| Restaurants | | | | | | | | | | | |
| Detergency/hand roughening | — | — | — | — | ○/○ | ○/○ | — | ○/○ | ○/○ | — | — |

Comparative Examples 6 to 8

Conventional detergents were prepared. Comparative Examples 6 and 7 represent dishwashing detergents, while Comparative Example 8 represents a home care product washing detergent. Table 9 shows their formulations and the results of evaluation of these products.

TABLE 9

| | Comparative Example | | |
|---|---|---|---|
| | 6 | 7 | 8 |
| Straight chain alkylbenzenesulfonate | 23.0 | 15.0 | |
| Polyoxyethylene alkyl ether | | 10.0 | 4.0 |
| Polyoxyethylene nonylphenyl ether | 7.0 | | |
| Tripotassium ethylenediaminetetraacetate | | | 5.0 |
| Diethylene glycol monobutyl ether | | | 5.0 |
| Linalool | | | 0.5 |
| Evaluation (hand roughening) | X | X | X |

As the results of Examples 77, etc. and Comparative Examples 3 to 5 demonstrate, a comparable washing effect was obtained using the surface active agent in an amount of one-seventh of the corresponding amount used in pure soaps and one-third or less of the corresponding amount used in washing detergents. For dishwashing, comparable washing effect was obtained using the surface active agent in an amount of one-tenth of the corresponding amount used in soap and one-third to one-sixth or less of the corresponding amount used in neutral detergents. Thus, it was found that adverse influence on the environment due to drainage of the surface active agent can be markedly diminished. The number of rinses was halved, whereby the usage charge for potable water can be decreased.

One or more chief ingredients selected from the group consisting of essential oils and essential oil components isolated from the essential oils or synthesized, used in the present invention, can perform hygiene control of objects to be washed, such as clothing and tableware, because of their disinfectant action, thus obviating the need for further disinfection. Furthermore, when a waste liquor after washing with them is flowed through a drain pipe, it is useful for sanitary control of the drain pipe. As noted from these facts, they exhibited a dual effect. These ingredients also have preservative action and rust preventive action. The essential oil and its isolated component of the present invention, which have disinfecting action, are lost upon vaporization in about 2 hours, thus having no effect on the environment.

The washing aqueous solution of the invention has pH of 8 or lower, close to neutrality. Thus, unlike conventional detergents, it is not necessary to use different detergents, depending on whether the object to be washed is cotton or wool.

The detergent composition of the invention, as a detergent for home care products, does not chap the skin even when adhering thereto, does not irritate the eye or mucosa by a scattered liquid, is safe and harmless, has disinfectant and bacteriostatic ability, has a rust preventive effect on a metal, has such excellent detergency as to be used without limitation, is free from organic solvents, and requires a reduced amount of a surfactant.

The detergent composition of the invention, as a manual dishwashing detergent, does not roughen the hand, is weakly acidic, has excellent detergency with a decreased amount of a surface active agent, turns into a waste liquid after washing to dissolve oils and fats depositing on a drainage pipe, thereby preventing its clogging, and comprises components which are safe to the environment.

To serve as an automatic dishwasher detergent, the detergent composition of the invention has antibacterial properties with excellent detergency.

This invention being thus described, it will be obvious that the same may be varied without departing from the spirit and scope of the invention, and all such modifications as would be obvious to one skilled in the art are intended to be included within the scope of the following claims.

What is claimed is:

1. An environment safeguarding aqueous detergent composition comprising (a) 0.1 to 20% by weight of one or more chief ingredients selected from the group consisting of essential oils and essential oil components which have been isolated from the essential oils or synthesized, wherein the essential oil component is selected from the group consisting of α- and/or β-pinene, limonene, linalool, geraniol α-, β- or γ-terpineol, terpinen-4-ol, linalyl acetate, and mixtures thereof, (b) 0.25 to 20% by weight of a surface active agent for solubilizing the chief ingredients, said surface active agent being selected from the group consisting of an N-acylamino acid salt, sucrose fatty acid esters, mixtures of fatty acid alkylolamides and sucrose fatty acid esters, mixtures of fatty acid alkylolamides and N-acylamino acid salt, and mixtures thereof, and (c) an enzyme, the weight ratio of the (a) to the (b) being in the range of 1:0.05 to 1:15.

2. The environment safeguarding aqueous detergent composition of claim 1, wherein the enzyme is selected from the group consisting of lipase, protease, amylase and cellulose.

3. An environment safeguarding, dishwashing detergent composition comprising (a) 0.1 to 5.0% by weight of an essential oil component selected from the group consisting of a terpene alcohol, limonene, pinene, linalyl acetate, and bornyl acetate, and (b) 3.0 to 20.0% by weight of an N-acylamino acid salt for solubilizing the above chief ingredient, said composition having pH in the range of 8.0 to 4.0.

4. The environment safeguarding, dishwashing detergent composition of claim 3, wherein the N-acylamino acid salt is selected from the group consisting of an N-acylalanine salt and an N-acylglutamate.

5. The environment safeguarding, dishwashing detergent composition of claim 3, wherein the terpene alcohol is selected from the group consisting of linalool, geraniol, α-, β- or γ-terpineol, terpinol-4, citronellol, and mixtures of these.

6. The environment safeguarding, dishwashing detergent composition of claim 3, further containing a sucrose $C_{6-18}$ fatty acid ester or a $C_{6-18}$ fatty acid alkylolamide.

7. An environment safeguarding, aqueous, home care products washing detergent composition containing the components (a) and (b) of claim 3 diluted with water at a dilution ratio of 2 or more.

* * * * *